United States Patent [19]

Hong et al.

[11] Patent Number: 4,640,355

[45] Date of Patent: Feb. 3, 1987

[54] LIMITED ENTRY METHOD FOR MULTIPLE ZONE, COMPRESSIBLE FLUID INJECTION

[75] Inventors: Ki C. Hong, Orange; Suzanne Griston, San Dimas; Joseph W. Ault, Moraga, all of Calif.

[73] Assignee: Chevron Research Company, San Francisco, Calif.

[21] Appl. No.: 716,292

[22] Filed: Mar. 26, 1985

[51] Int. Cl.[4] ..... E21B 36/00; E21B 43/12; E21B 43/18; E21B 43/24

[52] U.S. Cl. ..... 166/269; 166/57; 166/223; 166/250; 166/268; 166/272; 166/302; 166/303; 166/305.1; 166/312; 166/313

[58] Field of Search ..... 166/57, 66, 223, 222, 166/242, 250, 252, 258, 261, 268, 272, 302, 303, 305.1, 311, 312, 313, 373, 385, 269

[56] References Cited

U.S. PATENT DOCUMENTS

| | | | |
|---|---|---|---|
| 1,400,765 | 12/1921 | Pallette | 166/222 X |
| 1,565,574 | 12/1925 | Larsen | 166/302 |
| 1,861,332 | 5/1932 | Waitz | 166/222 X |
| 2,019,418 | 10/1935 | Lang | 166/269 |
| 2,871,948 | 2/1959 | Normand | 166/222 |
| 3,098,524 | 7/1963 | Brown | 166/313 |
| 3,905,553 | 9/1975 | Bradley et al. | 166/305.1 X |
| 4,042,026 | 8/1977 | Pusch et al. | 166/258 |
| 4,046,199 | 9/1977 | Tafoya | 166/222 X |
| 4,081,028 | 3/1978 | Rogers | 166/242 |
| 4,248,302 | 2/1981 | Churchman | 166/272 |
| 4,274,487 | 6/1981 | Hollingsworth et al. | 166/261 |
| 4,452,309 | 6/1984 | Widmyer | 166/303 |

OTHER PUBLICATIONS

G. P. Small, "Steam-Injection Profile Control . . . " SPE 13607 Bakersfield, Calif.; Mar. 27–29, 1985, pp. 199–203.

G. P. Small, "Steam Injection Profile Control . . . " (Abstract of SPE Paper) Pacific Oil World, Mar. 1985, p. 36.

Baker Oil Tools, *Composite Catalogue of Oil Field Equipment and Services,* 1982–1983 Edition published by World Oil, pp. 974–977.

C. F. Gates and S. W. Brewer, "Steam Injection into the D and E Zone . . . " JPT Mar. 1975 pp. 343–348.

Glen Bigelow, "Completion Techniques for Steam Injection Wells" Baker Packers Thermal Systems (Article) pp. 1 to end.

Glen Bigelow, "Completion Techniques for Steam Injection Wells", API Pacific Coast Joint Chapter Meeting, Bakersfield Calif., Nov. 8–10, 1983.

*Primary Examiner*—George A. Suchfield

*Attorney, Agent, or Firm*—J. A. Rafter, Jr.; Edward J. Keeling

[57] ABSTRACT

The present invention is a method and apparatus for injecting compressible fluids into multiple zones of a hydrocarbon bearing formation, in particular injecting compressible fluid at a predetermined, constant rate into multiple zones through a single tubing string. Producing zones are packed off and limited entry outlets are installed on the injection tubing string at each producing zone. Injection pressure is maintained and limited entry outlets are designed and sized such that the compressible fluid reaches sonic flow through the outlets so that the flow rate no longer responds to changes in downstream pressures.

25 Claims, 7 Drawing Figures

□ 200 BBLS / DAY
○ 300 BBLS/ DAY
△ 400 BBLS/ DAY
+ 500 BBLS / DAY
CRITICAL FLOW REGION
OUTLET AREA (SQ. IN.)
0.24
0.21
0.18
0.15
0.12
0.09
0.06
0.03
0.00
0.0
50.0
100.0
150.0
200.0
250.0
300.0
350.0
400.0
450.0
500.0
PRESSURE DROP (PSI)

LIMITED ENTRY METHOD FOR MULTIPLE ZONE, COMPRESSIBLE FLUID INJECTION

BACKGROUND OF THE INVENTION

The present invention pertains in general to methods for multiple zone, compressible fluid injection and in particular to methods for compressible fluid injection into multiple zones of a hydrocarbon bearing formation using a single tubing string.

An oil-producing well may pass through several petroleum containing strata or sand members, i.e. producing zones separated by non-producing zones. These producing strata may differ in permeability, homogeneity and thickness. Furthermore, the petroleum in these producing strata may differ in amount, viscosity, specific gravity and average molecular weight.

Compressible fluids are commonly injected into oil formations to enhance oil production. Compressible fluids are defined as fluids that can achieve sonic flow when passed through a restriction. For a given set of upstream conditions, the flow rate of a compressible fluid through a restriction will increase as the absolute pressure ratio ($P_{downstream} / P_{upstream}$) decreases until the linear velocity of the compressible fluid in the restriction reaches the local speed of sound. When sonic flow is reached, the flow no longer responds to changes in the downstream pressure.

Examples of compressible fluids are gases such as air, $N_2$, CO, $CO_2$, $CH_4$, flue gas, natural gas, dry steam and the like, and mixtures of two phase fluids like gases and liquids such as wet steam. Wet steam is defined as steam that has a liquid phase, i.e. less than 100% vapor phase steam. For example, 80% quality steam has a liquid phase of 20% by mass.

Where petroleum within a stratum is so viscous that the temperature and pressure within the stratum are insufficient to cause it to flow to a producing well, hot fluids, particularly steam, are injected into such strata in order to raise the temperature of the stratum and thereby reduce the viscosity of the petroleum contained therein to a point at which the petroleum be moved to a producing wellbore. Oil production may also be enhanced by injection of gases such as nitrogen, carbon dioxide or flue gas alone or in combination with steam.

In wells containing multiple producing zones, it may be desirable to simultaneously treat more than one stratum with compressible fluids at the same time. These strata may require different rates of injection to optimize production therefrom. For typical compressible fluid injection, injection tubing is run into wells within the casing to each production zone. Packers are placed between the tubing and the casing above and sometimes below the stratum to be injected. Next, the wellhead is connected to a source of compressible fluid, such as a steam generator, and the fluid is pumped into the stratum formation through the tubing. The steam quality is either not monitored or only controlled at the surface as taught by U.S. Pat. No. 4,149,403. Thus the exact quality of the steam and the actual injection rate down the wellbore at the producing zone is not accurately known. In addition, very deep formations would require an excessive wellhead pressure because of the pressure loss across the surface choke and the frictional losses as the compressible fluid moves down the tubing.

Another method of injecting fluids simultaneously into different strata involves employing multiple channels with each channel injecting fluid into different strata. For example, the concentric tubing strings of the sort shown in U.S. Pat. No. 4,399,865, are formed by running a first steam-bearing pipe within a second to form two flow channels. The concentric tubing acts as a long heat exchanger which tends to plug up when used with hard water steam injection. Still another method utilizes a multichannel conduit of the sort shown in U.S. Pat. No. 4,424,859. The conduit is composed of a plurality of contiguous flow channels within a cylindrical shell. The cost of the injection operation and the efficiency would be improved if, preferably, a single tubing string could be utilized.

U.S. Pat. No. 4,248,302 teaches the use of a dual tubing strings with side pocket mandrels which incorporate "constant flow regulators or orifice regulators". However dual tubing strings will not fit into small diameter casings found in many wells. In addition, the reference does not teach "constant flow or orifice regulators" which operate or function on the basis of sonic flow conditions. The "Model 'BF'" downhole flow regulator specified by the reference was designed for water, a non-compressible fluid. It operates by varying a port opening in response to a change in either tubing or formation pressure, i.e. it throttles the flow of fluid which is not at sonic flow condition. In addition, it is generally desirable for downhole tools to be without moving parts for simplicity and reliability.

In small diameter casings which have room for only a single tubing string, it may be desirable to inject fluid into more than one strata from that single tubing string. Typically, an injection tubing string with an open end is hung inside a casing which is perforated at each producing zone. In another method, the casing is perforated and holes are drilled in the tubing at the producing zones. The tubing is packed off within the casing above and below the perforations. When injecting a compressible fluid such as steam, it is desirable to maintain at predetermined values both the quality and flow rate of steam injected into each producing zone. Heretofore, the split between producing zones of compressible fluid injected down a single tubing string could not be accurately controlled.

Injection rate depends on tubing fluid pressure, formation pressure, and the size of injection ports (for example the tubing holes). Since these pressures can change, (particularly the formation pressure will change during the period of injection life) injection rates into one or more producing zones are not readily controllable. Pressure and spinner surveys generally indicate that most of the steam tends to flow into the producing zones or adjacent non-producing zones that have the lowest pressure and highest permeability. Non-producing zones such as water bearing zones, tend to preferentially divert the vast majority of the steam away from the producing zones. These tendencies drastically increase costs and reduce production of hydrocarbons.

Thus, there is currently a need for a practical means and method to control the distribution of compressible fluids and particularly steam between different producing zones and at predetermined rates. Preferably, there is a need for this to be accomplished with a single tubing string injecting into more than one producing zone.

SUMMARY OF THE INVENTION

Accordingly, the present invention involves a method and apparatus for multiple zone compressible fluid injection through a well using a limited entry outlet for the compressible fluid adjacent to the producing zone, i.e. on the downhole end of the injection tubing. Preferably the limited entry outlets are used in conjunction with a single tubing string. The well and tubing string are packed off to establish at least two zones. A compressible fluid is injected down the tubing string through a limited entry outlet at each zone and into the formation. A limited entry outlet is defined to be an outlet such as a choke which has the compressible fluid passing therethrough under sonic flow conditions. Sonic flow conditions occur when the linear velocity of the compressible fluid reaches the local speed of sound and the flow rate no longer responds to changes in downstream (reservoir) pressure, hence the term limited entry. The limited entry outlets are sized and the compressible fluid injection pressure is maintained to achieve predetermined injection rates through all of the limited entry outlets. The limited entry outlet design and size may be chosen, if desired, to provide a different predetermined constant flow rates of compressible fluid for each producing zone to be injected.

DESCRIPTION OF THE PREFERRED EMBODIMENTS

Figure 1:
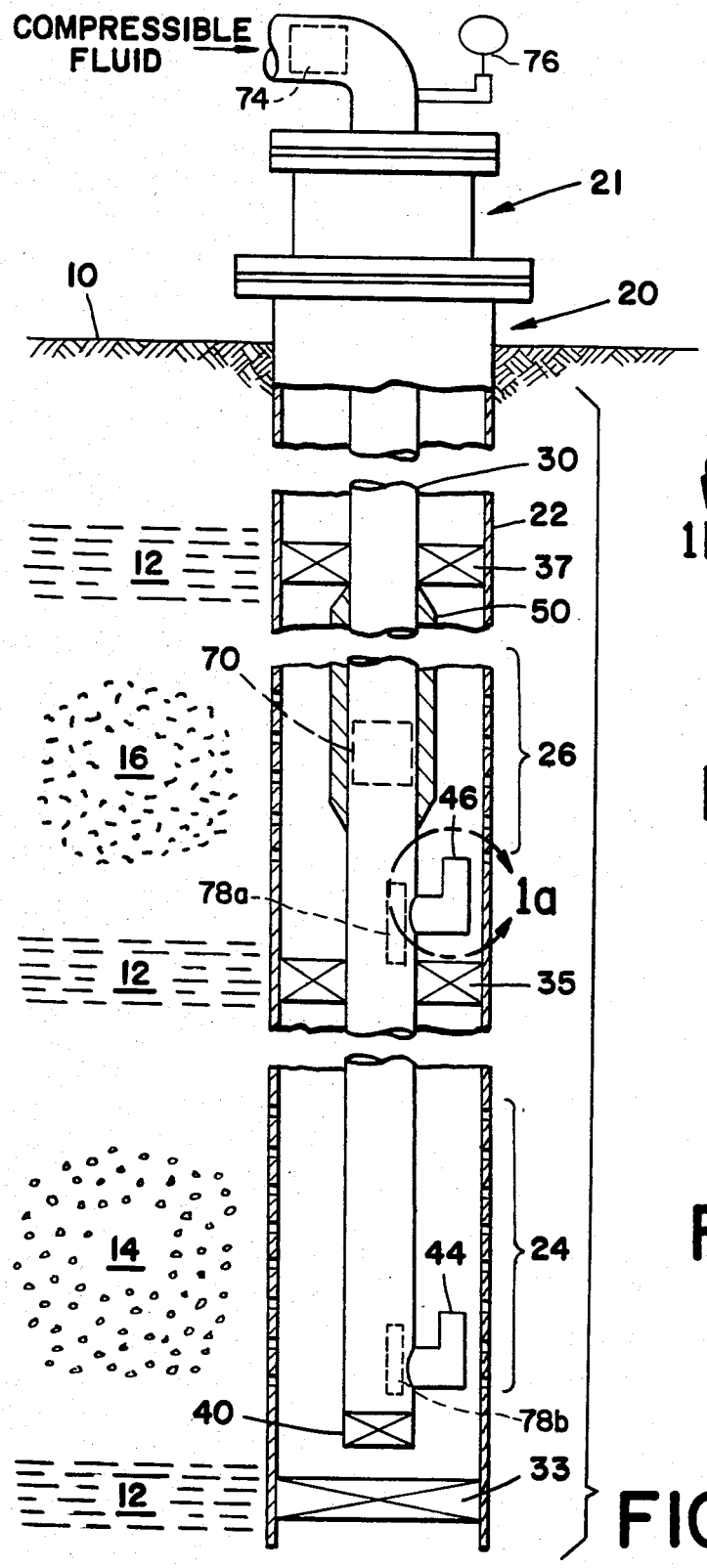
FIG. 1 is a schematic view showing the nozzle design according to the present invention.

An exemplary apparatus for practicing the preferred embodiments of the present invention is illustrated in FIG. 1. An earth formation 10 has strata or sand zones of interest, i.e. producing zones 14 and 16 penetrated by a well 20. Impermeable strata 12 which are non-producing zones separate the producing zones 14 and 16 from other zones and each other. The well 20 has a casing 22 containing perforations 24 adjacent producing zone 14 and perforations 26 adjacent producing zone 16.

The producing zones 14 and 16 are packed off by installing a packer 35 between producing zone 14 and producing zone 16. The upper annulus region of well 20 may be pressurized, for example, with nitrogen, to prevent escape of injected fluid up the annulus. A packer 37 may be installed above sand member 16 to isolate injection areas from the upper annulus region of well 20. If required, an additional packer 33 may be placed below sand producing zone 14 to isolate this injection area from lower annulus region of well 20.

A single tubing string 30 is hung within the well 20 through a wellhead 21. Outlets 44 and 46 are provided in the tubing string 30 at the producing zones 14 and 16 respectively. The outlets 44 and 46 in FIG. 1 illustrate a nozzle configuration. The outlets 44 and 46, illustrated as nozzles, are designed and sized such that compressible fluid injected down the tubing string 30 reaches sonic flow conditions at a predetermined desired rate when passing therethrough. Any outlet is suitable provided that sonic flow conditions occur during the passing of the compressible fluid. If desired, the outlets 44 and 46 may be sized so that sonic flow conditions occur at different rates. This sizing permits the precise selection of an injection rate to be optimized for a specific producing zone. A plurality of outlets may be located in the tubing. The tubing could be configured to have passages that permit the steam to escape under sonic flow conditions.

Figure 1A:
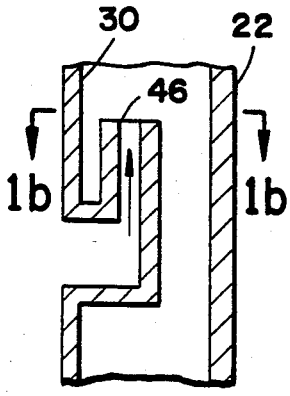
FIG. 1*a* illustrates details of the nozzle design.
Figure 1B:
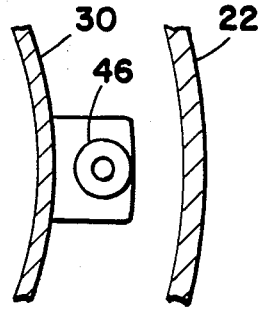
FIG. 1*b* is a sectional view of FIG. 1*a;*

FIGS. 1*a* and 1*b* provide a detailed illustration of the outlet 46 a nozzle which may be directed upward to produce fluid mixing in the annulus between the casing 22 and the tubing string 30. In an application where steam is the compressible fluid injected, this mixing should make the quality of steam uniform over the perforations 26 or 24 within the given producing zones 16 or 14. A preferred embodiment would tilt the outlet nozzle 46 slightly from the vertical to produce a swirling action in the annulus, which is believed to further enhance the action of fluid mixing.

It is desirable that any injected compressible fluid be homogenized so a uniform fluid composition is injected into the producing zones. For example, in steam injection the liquid and vapor phases may separate as the liquid has a tendency to collect on the tubing walls and the bottom. Mixing may prove important when certain additives such as surfactants are mixed with the compressible fluid. To ensure homogenization, a mixing device may be installed in tubing string 30 upstream of any outlet. For example, a static mixer 70 is located in the tubing string 30 immediately upstream of the outlet 46. The static mixer 70 may be any suitable mixer such as static mixers available from Koch Engineering Company, Inc., Wichita, Kans.

Figure 2:
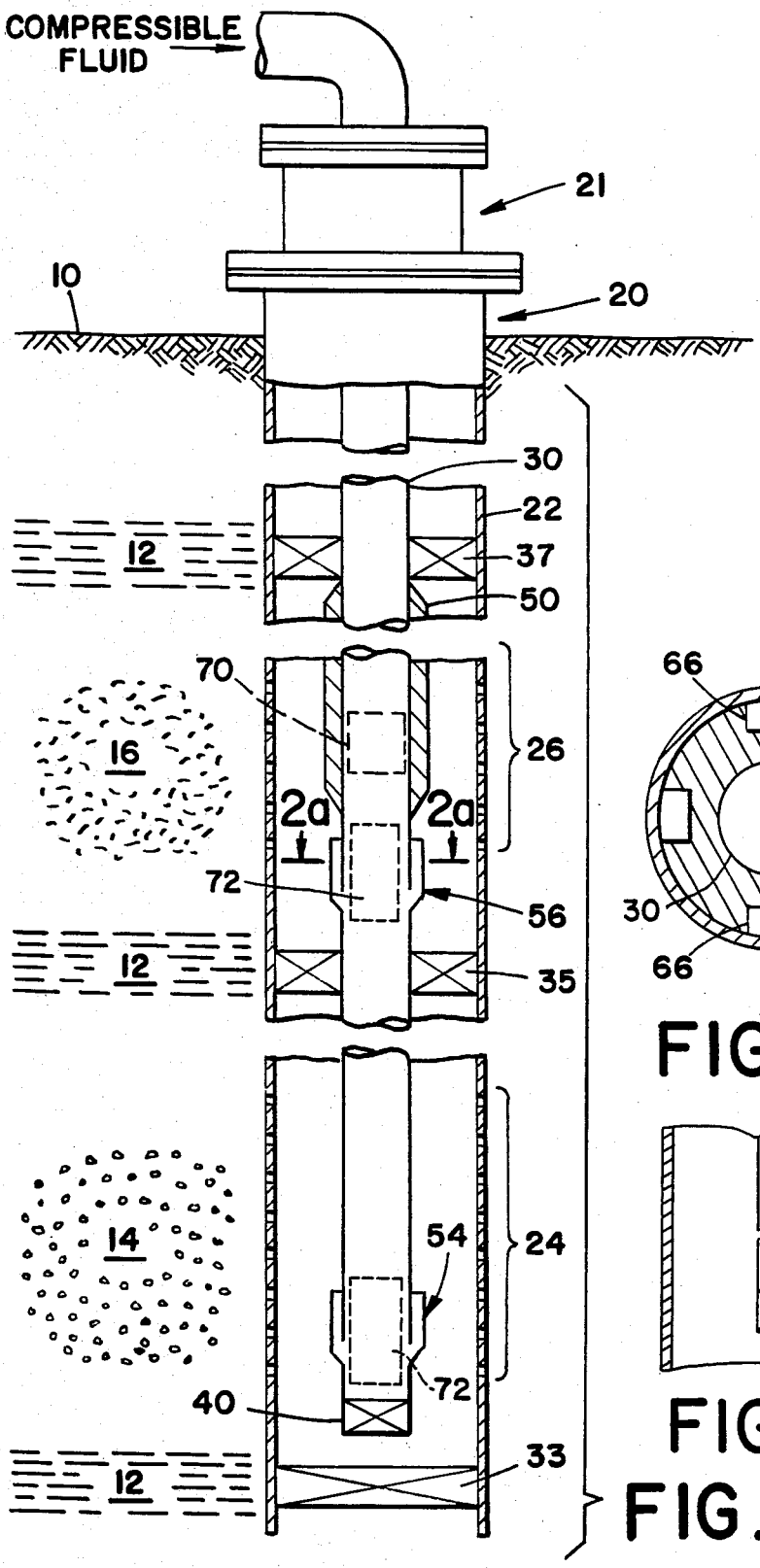
FIG. 2 is a schematic view showing the deflector design according to the present invention.
Figure 2A:
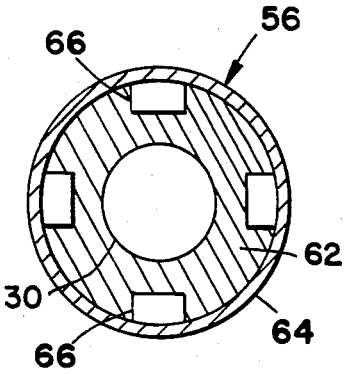
FIG. 2*a* illustrates details of the deflector design.

All components in FIG. 2 are identical to components in FIG. 1 except FIG. 2 illustrates an alternative outlet design that employs the concept of the gas deflectors 54 and 56 in place of the outlet nozzles 44 and 46 of FIG. 1. FIG. 2*a* illustrates more specific details of the gas deflector 56. The gas deflector 56 attached to tubing string 30 is comprised of a set of milled slots 66 between the outer skirt 64 and the mandrel 62. The sizes of the slots 66 can be adjusted such that the total cross-sectional area of the slot openings is the same as that for the outlet nozzle 46 of FIG. 1. Gas deflectors 56 and 54 are placed near the bottom of the producing zones 16 and 14 and are directed upward to produce fluid mixing in the annulus between tubing string 30 and the casing 22. The gas deflectors may be preferred for wells which require tubing to be pulled frequently as the gas deflector design may provide easier manipulation.

The tubing string 30 above the packer 37 may be bare or insulated. However, the section of the tubing string 30 between the packers 35 and 37 (that portion of the tubing surrounded by perforations in the top interval) should preferably be insulated tubing. The insulated tubing 50 is needed to minimize the reduction of steam quality inside the tubing string 30 that can result from the large temperature drop between the high pressure steam inside the tubing string 30 and the flashed, low pressure steam in the annulus between the tubing 30 and the casing 22.

Figure 4:
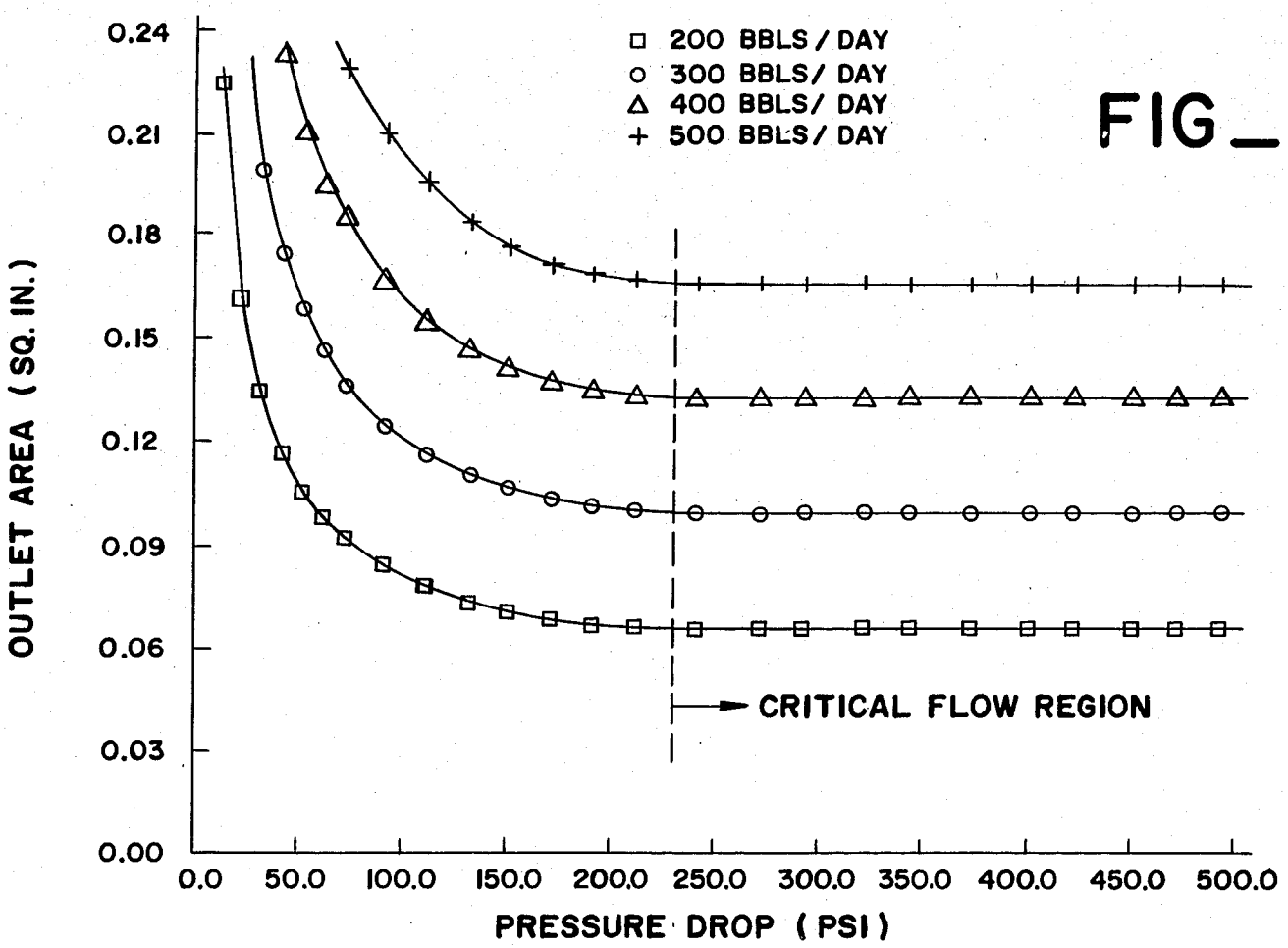
FIG. 4 is a plot of critical flow outlet size versus pressure drop across outlet.

The outlet nozzle 46 is sized and compressible fluid injected down the tubing string 30 at an injection pressure such that the pressure drop across the outlet, i.e., nozzle 46, is greater than that required to produce sonic velocity. The present invention may accommodate injection of any compressible fluid including gases, air, nitrogen, carbon dioxide, hydrocarbon gas, methane, flue gas, natural gas, and two phase fluids such as steam. Steam is a particularly applicable compressible fluid for the present invention. Under sonic conditions, the rate of steam flow into each producing zone depends only on the upstream conditions and the outlet size which are controllable. Any change in downstream pressure will not change the injection rate. The critical flow equation for gases, adjusted for the presence of condensate in a two-phase steam, is used to compute the relationship between outlet size and pressure drop for a range of steam injection rates likely to occur in a field application. The results are plotted in FIG. 4. This plot is for steam injected at a fixed injection pressure of 500 psia and upstream steam quality of 50%, i.e., the liquid phase is 50% by mass. As shown in FIG. 4, the outlet area (choke size) necessary for critical flow is a function only of the steam flow rate, and is independent of the pressure drop. The design outlet size varies between 0.066 sq. in. for 200 B/D steam and 0.161 sq. in. for 500 B/D steam.

The actual injection pressure selected will depend on desired flow rate, selected outlet size, and formation pressure. Typical injection pressures may range between three and ten times formation pressure.

It is anticipated that a constant injection rate is desired for the life of the injection well or injection project. There may be instances, however, where an injection rate need be changed. For example, referring to FIG. 1, the tubing string 30 may be pulled and the outlet nozzle 46 changed to a different size. The tubing string 30 may then be reinstalled and injection rate to sand member 16 will be changed accordingly.

Figure 2B:
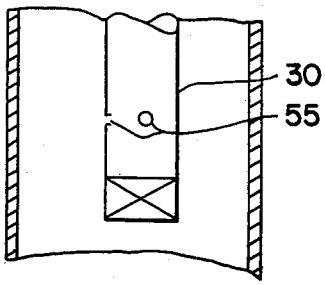
FIG. 2*b* is a schematic view showing the hole design according to the present invention.

It is also envisioned that the limited entry outlets may be changed from the surface. For example, integrated units of outlet nozzles 44 and 46 of FIG. 1 may be changed out by wireline. Another example would comprise a wireline attached to means for changing size 72 of gas deflectors 54 and 56 of FIG. 2. Suitable equipment for means for changing size 72 is available from oil field equipment suppliers as readiy modified by one skilled in the art. By pulling on the wireline, the size of slot 66 (FIG. 2*a*) may be adjusted from the surface. FIG. 2*b* illustrates alternative limited entry outlets as holes 55 in tubing string 30.

Since the limited entry outlets are smaller than typical injection outlets, it is important that they remain free of obstructions or deposits. Periodically the outlets may be flushed with a solvent to remove the buildup of deposits. The solvent selected will depend on formation conditions and the type of obstruction. Water may prove effective in removing most scale deposits or debris.

It is desirable to monitor both injection pressure and injection rates of the injected compressible fluids. Monitoring devices may be located at the surface or downhole. FIG. 1 illustrates a means for monitoring injection rate 74, a means to monitor injection pressure 76 on the surface, and a means for independently monitoring downhole injection pressure 78*a/b*. Suitable monitoring equipment is available from oil field equipment suppliers. It may prove particularly useful to monitor downhole conditions, for example, to measure the injection rate split between producing zones 14 and 16 of FIG. 1.

The monitoring information may also prove useful to determine if there is an obstruction in a limited entry outlet. A sudden reduction in injection rate or increase in injection pressure may indicate an outlet is plugged and requires flushing with solvent.

Figure 3:
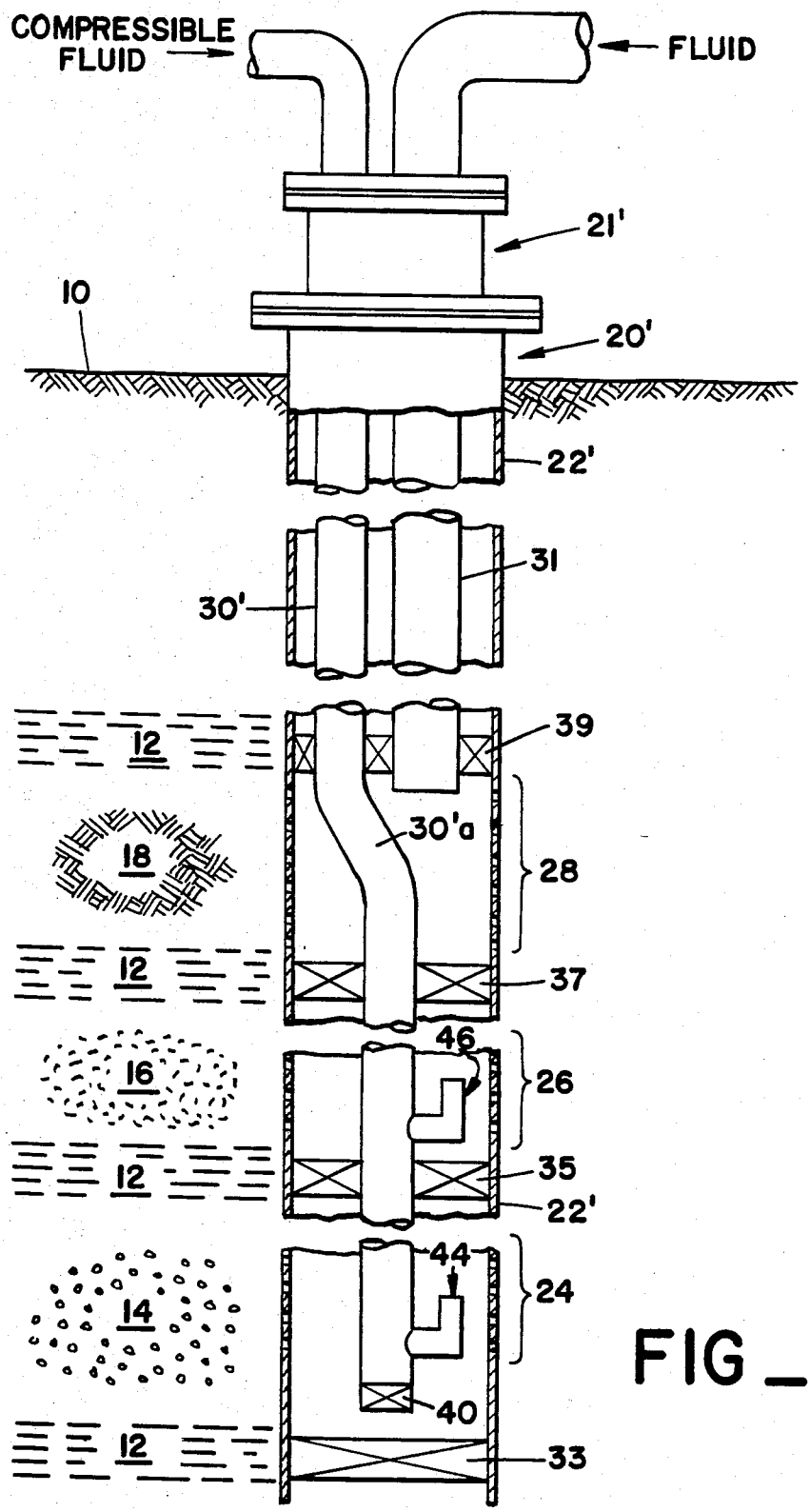
FIG. 3 is an embodiment of the present invention including a parallel injecting string.

The present invention may be combined with the parallel injection string method described in U.S. patent application Ser. No. 611,794 filed May 18, 1984 now U.S. Pat. No. 4,595,057, completely incorporated herein by reference for all purposes. The combination method, illustrated in FIG. 3, shows an impermeable strata 12 separating producing zones 14, 16, and 18 from other strata and each other. The well 20' has a casing 22'. The casing 22' includes perforations 24, 26, and 28 at producing zones 14, 16 and 18, respectively. The tubing strings 30' and 31 are hung within the well 20' through a wellhead 21'. A section 30'*a* of the tubing string 30' between packers 37 and 39, is bent to centralize the tubing string 30' at the packer 37 and should be insulated to minimize heat transfer. All components in the well 20' below the packer 37 of FIG. 3 are identical to components in FIG. 1 and are referenced by the same numerals.

The combination method is an embodiment wherein a second tubing string 31 parallels single tubing string 30'. The second tubing string 31 ends at producing zone 18. The tubing strings 30' and 31 are physically separated to minimize heat transfer. While injecting compressible fluid at a first temperature down the single tubing string 30', a second fluid at a second temperature is injected down the second tubing string 31. The second fluid is applied to producing zone 18 while simultaneously applying the compressible fluid to sand members 14 and 16. Of course, a compressible fluid could also be injected down the tubing string 31.

The insulated tubing 50 in FIG. 1 or FIG. 2 and the insulated tubing section 30'*a* in FIG. 3 may be any suitable insulated tubing, such as that sold under the THERMOCASE 550 trademark by General Electric, Thermal Systems Marketing Division, Tacoma, Wash. All other components of apparatus for practicing the present invention are readily obtainable or readily modifiable from readily obtained equipment by those skilled in the art.

Most injection wells are cased wells and though only cased wells are described herein, it is envisioned that an injection well in a suitable consolidated formation may be completed without casing. Packers may be placed in the open hole and the present invention otherwise operated as described herein for cased wells.

Although specific embodiments of the preferred invention have been described herein, the invention is not limited to only these embodiments described. For example, the limited entry outlets could be connected to the downhole ends of the tubing strings in U.S. Pat. Nos. 4,399,865 and 4,424,895. Another example is sizing holes in the tubing string or perforations in the casing to function as limited entry outlets. These and other modifications obvious to the ordinary skilled artisan are contemplated to be within the scope of the invention. The invention is to be given the broadest possible interpretation within the scope of the appended claims.

What is claimed is:

1. A method for injecting compressible thermal fluid at a constant injection rate into two or more producing zones of a formation through a single tubing string in an injection well comprising the steps of:

installing casing in said injection well having perforations at each of said producing zones;

installing a single tubing string in said injection well;

providing outlets in said tubing string at each of said producing zones;

packing off said single tubing string substantially adjacent to each of said producing zones;

insulating the single tubing string through the packed off producing zones to minimize heat transfer between fluid in the tubing string and fluid outside the tubing string; and injecting compressible thermal fluid down said single tubing string at an injection pressure which will produce sonic flow of compressible fluid through said outlets of said tubing string.

2. The method of claim 1 further comprising the step of selecting size of said outlets to achieve sonic flow of compressible fluid through said outlets.

3. The method of claim 1 wherein said injection pressure is from three to ten times the pressure in the formation.

4. The method of claim 1 further comprising the step of:

mixing said compressible fluid upstream of said outlets to homogenize fluid flow.

5. The method of claim 1 further comprising the steps of:

paralleling said single tubing string with a second tubing string;

ending said second tubing string at one of said producing zones, wherein said second tubing string is separated from said single tubing string;

injecting a second fluid at a second temperature into said second tubing string while injecting compressible fluid down said single tubing string;

insulating said tubing strings through said producing zones where one tubing string comes in contact with fluid from the other tubing string to minimize heat transfer between fluid inside a tubing string and fluids in the annulus; and applying said second fluid to one of said producing zones while simultaneously applying said compressible thermal fluid to a different producing zone.

6. A method for injecting compressible fluid at a constant injection rate into one or more producing zones of a formation through a single tubing string in an injection well comprising the steps of:

installing a single tubing string in said injection well;

providing outlets in said tubing string at each of said producing zones;

packing off said single tubing string substantially adjacent to each of said producing zones;

injecting compressible fluid down said single tubing string at an injection pressure which will produce sonic flow of compressible fluid through said outlets of said tubing string; and changing the size of said outlets thereby adjusting the constant injection rate.

7. The method according to claim 1 further comprising the step of injecting additives along with said compressible fluid.

8. The method of claim 1 wherein the compressible fluid is selected from the group consisting of nitrogen, carbon dioxide, methane, air, gas, flue gas, steam and mixtures thereof.

9. A method for injecting compressible fluid at a constant injection rate into one or more producing zones of a formation through a single tubing string in an injection well comprising the steps of:

installing a single tubing string in said injection well;

providing outlets in said tubing string at each of said producing zones;

packing off said single tubing string substantially adjacent to each of said producing zones;

injecting compressible fluid down said single tubing string at an injection pressure which will produce sonic flow of compressible fluid through said outlets of said tubing string; and flushing said outlets periodically with a solvent to remove buildup of deposits.

10. The method of claim 9 further comprising the steps of:

monitoring said injection pressure and when said injection pressure increases above a predetermined value;

flushing said outlets with a solvent to remove buildup of deposits.

11. The method of claim 9 further comprising the steps of:

monitoring total injection rate into said tubing string; and when said total injection rate decreases below a predetermined rate, flushing said outlets with a solvent to remove buildup of deposits.

12. A method for injecting compressible fluid at a constant injection rate into one or more producing zones of a formation through a single tubing string in an injection well comprising the steps of:

installing a single tubing string in said injection well;

providing outlets in said tubing string at each of said producing zones;

packing off said single tubing string substantially adjacent to each of said producing zones;

injecting compressible fluid down said single tubing string at an injection pressure which will produce sonic flow of compressible fluid through said outlets of said tubing string; and mixing said compressible fluid upstream of said outlets to homogenize fluid flow, wherein said step of mixing is carried out by an inline mixing device located in said single tubing string upstream of said outlets.

13. An apparatus for injecting a compressible thermal fluid into a well penetrating at least two zones through a single tubing string comprising:

casing within the well having perforations providing communication to an upper producing zone and to a lower producing zone from within the casing;

first packer means for establishing a first zone within the well adjacent the perforations in the casing to provide communication with lower producing zone;

second packer means above the first packer means and cooperating therewith to establish a second zone adjacent the perforations in the casing and to provide communication with the upper producing formation;

a single injection tubing string within said well;

at least one outlet in said single tubing string at each of said producing zones, said outlets sized such that the compressible thermal fluid reaches sonic flow through each of said outlets into each of said producing zones; and insulation means on said single tubing string above said first packer means and extending to said second packer means to minimize heat transfer between fluid in the tubing string and fluid outside the tubing string.

14. The apparatus according to claim 13 wherein said outlet is a nozzle.

15. The apparatus according to claim 13 wherein said outlet is a gas deflector.

16. The apparatus according to claim 13 wherein said outlet is a hole located on said single tubing string.

17. The apparatus according to claim 13 further comprising means for changing size of said outlet thereby adjusting injection rate.

18. The apparatus according to claim 13 further comprising means for monitoring injection pressure.

19. The apparatus according to claim 13 further comprising means for independently monitoring downhole injection pressure into each producing zones.

20. The apparatus according to claim 13 further comprising means for monitoring total injection rate to said single tubing string.

21. The apparatus according to claim 13 further comprising means for monitoring injection rate into each of said producing zones.

22. The apparatus according to claim 13 further comprising a mixing device located in said single tubing string upstream of said outlets to homogenize flow of said compressible fluid.

23. An apparatus for injecting a first compressible thermal fluid at a constant injection rate into a plurality of producing zones through a well comprising:

a well penetrating at least an upper and a lower producing zone;

casing within the well having perforations providing communication to the upper producing zone and to the lower producing zone from within the casing;

first packer means for establishing a first zone within the injection well adjacent the perforations in the casing to provide communication with lower producing zone;

second packer means above the first packer means and cooperating therewith to establish a second zone adjacent the perforations in the casing and to provide communication with the upper producing formation;

a first injection tubing string within said well;

at least one outlet in said first injection tubing string at each of at least two of said producing zones, said outlets in said first injection tubing string sized such that the compressible thermal fluid reaches sonic flow through each of said outlets into each of said producing zones; and insulation means on said first injection tubing string above said first packer means and extending to said second packer means to minimize heat transfer between fluid in the first tubing string and fluid outside the first tubing string at the producing zones.

24. The apparatus according to claim 23 wherein each tubing string has a set of outlets adjacent a particular producing zone.

25. The apparatus according to claim 23 further comprising:

perforations in the casing providing communication with a third producing formation above the upper producing formation;

third packer means above the second packer means and cooperating therewith to establish a third zone adjacent the perforations in the casing to provide communication with the third producing formation;

a second injection tubing string extending from the earth's surface and ending in a producing zone not having outlets from said first injection tubing string; and insulation means on said injection tubing strings above said first packer means and extending to said third packer means to minimize heat transfer between fluids in the tubing strings and fluid outside the tubing strings at the producing zones.

* * * * *